US005802433A

United States Patent [19]

Sato et al.

[11] Patent Number: 5,802,433

[45] Date of Patent: Sep. 1, 1998

[54] TONER FRAME, PROCESS CARTRIDGE AND ELECTROPHOTOGRAPHIC IMAGE FORMING APPARATUS

[75] Inventors: Minoru Sato, Yokohama; Isao Ikemoto, Kawasaki, both of Japan

[73] Assignee: Canon Kabushiki Kaisha, Tokyo, Japan

[21] Appl. No.: 635,199

[22] Filed: Apr. 19, 1996

[30] Foreign Application Priority Data

Apr. 20, 1995 [JP] Japan ..... 7-094730

[51] Int. Cl.[6] ..... G03G 15/00; G03G 21/18

[52] U.S. Cl. ..... 399/111

[58] Field of Search ..... 399/111, 113, 399/119, 120

[56] References Cited

U.S. PATENT DOCUMENTS 5,294,960 3/1994 Nomura et al. ..... 399/113
5,450,166 9/1995 Yashiro ..... 399/111
5,537,187 7/1996 Sekine ..... 399/113
5,596,388 1/1997 Ohkubo et al. ..... 399/111

*Primary Examiner*—Arthur T. Grimley
*Assistant Examiner*—Sophia S. Chen
*Attorney, Agent, or Firm*—Fitzpatrick, Cella, Harper and Scinto

[57] ABSTRACT

The present invention provides a process cartridge removably mounted to an image forming apparatus, including an electrophotographic photosensitive member, a process mechanism acting on the electrophotographic photosensitive member, a toner containing portion for containing toner used for developing a latent image formed on the electrophotographic photosensitive member, and a grip portion provided contiguous with the toner containing portion and disposed between one longitudinal end and the other longitudinal end of the toner containing portion. The grip portion has a cavity exposed outside and extending in a longitudinal direction of the toner containing portion and defined between upper and lower surfaces of the grip portion. The process cartridge is mounted and dismounted with respect to the image forming apparatus along a direction transverse to a longitudinal direction of the electrophotographic photosensitive member.

45 Claims, 6 Drawing Sheets

TONER FRAME, PROCESS CARTRIDGE AND ELECTROPHOTOGRAPHIC IMAGE FORMING APPARATUS

BACKGROUND OF THE INVENTION

1. Field of the Invention

The present invention relates to a toner frame, a process cartridge and an electrophotographic image forming apparatus, which can form an image by an electrophotographic process.

2. Ralated Background Art

In image forming apparatuses such as electrophotographic printers, an electrophotographic photosensitive member uniformly charged by a charger is selectively exposed to form a latent image. The latent image is then visualized by a developing device with developer (referred to as "toner" hereinafter) to form a toner image. Then, the toner image is transferred onto a recording medium, thereby recording an image on the recording medium. In such electrophotographic image forming apparatuses, the electrophotographic photosensitive member, charger, developing device and cleaning member are integrally assembled as a cartridge unit which can be removably mounted to the image forming apparatus by an operator. With this arrangement, when the toner is consumed or when a service life of any part such as the electrophotographic photosensitive member is expired, the cartridge can easily be exchanged by a new one, thereby facilitating the maintenance.

Regarding such process cartridges, so-called derivative cartridges each having a toner amount different from a toner amount of a standard cartridge can be prepared on operator's demand. For example, in comparison with the standard cartridge capable of copying 3000 sheets, a deviative cartridge having a smaller amount of toner and capable of 2000 sheets or a derivative cartridge having a smaller amount of toner and capable of 1500 sheets can be provided.

The present invention relates to an improvement in the above-mentioned process cartridge.

SUMMARY OF THE INVENTION

An object of the present invention is to provide a process cartridge in which the operability for mounting the process cartridge to an image forming apparatus can be improved, a toner frame used with such a process cartridge, and an electrophotographic image forming apparatus to which such a process cartridge can be mounted.

Another object of the present invention is to provide a process cartridge in which an amount of toner contained in the process cartridge can easily be recognized by an operator on the basis of a shape of the process cartridge, a toner frame used with such a process cartridge, and an electrophotographic image forming apparatus to which such a process cartridge can be mounted.

A further object of the present invention is to provide a process cartridge adapted to be removably mounted to an image forming apparatus, comprising an electrophotographic photosensitive member, a process means acting on the electrophotographic photosensitive member, a toner containing portion for containing toner used for developing a latent image formed on the electrophotographic photosensitive member, and a grip portion provided contiguous with the toner containing portion and disposed between longitudinal one end and the other end of the toner containing portion and having a cavity exposed outside and extending in a longitudinal direction of the toner containing portion and defined between upper and lower surfaces of the grip portion. The process cartridge is mounted and dismounted with respect to the image forming apparatus along a direction transverse to a longitudinal direction of the electrophotographic photosensitive member.

A still further object of the present invention is to provide a toner frame used with a process cartridge which includes an electrophotographic photosensitive member and a process means acting on the electrophotographic photosensitive member and which can be mounted on and dismounted from image forming apparatus along a direction transverse to a longitudinal direction of the electrophotographic photosensitive member, comprising a toner containing portion for containing toner used for developing a latent image formed on the electrophotographic photosensitive member, and a grip portion provided contiguous with the toner containing portion and disposed between longitudinal one end and the other end of the toner containing portion and having a cavity exposed outside and extending in a longitudinal direction of the toner containing portion and defined between upper and lower surfaces of the grip portion.

The other object of the present invention is to provide an image forming apparatus to which a process cartridge can removably be mounted and which is adapted to form an image on a recording medium, comprising a mounting means capable of removably mounting the process cartridge including an electrophotographic photosensitive member, a process means acting on the electrophotographic photosensitive member, a toner containing portion for containing toner used for developing a latent image formed on the electrophotographic photosensitive member, and a grip portion provided contiguous with the toner containing portion and disposed between longitudinal one end and the other end of the toner containing portion and having a cavity exposed outside and extending in a longitudinal direction of the toner containing portion and defined between upper and lower surfaces of the grip portion; and a convey means for conveying the recording medium. The process cartridge is mounted on and dismounted from the image forming apparatus along a direction transverse to a longitudinal direction of the electrophotographic photosensitive member.

DESCRIPTION OF THE PREFERRED EMBODIMENTS

Figure 1:
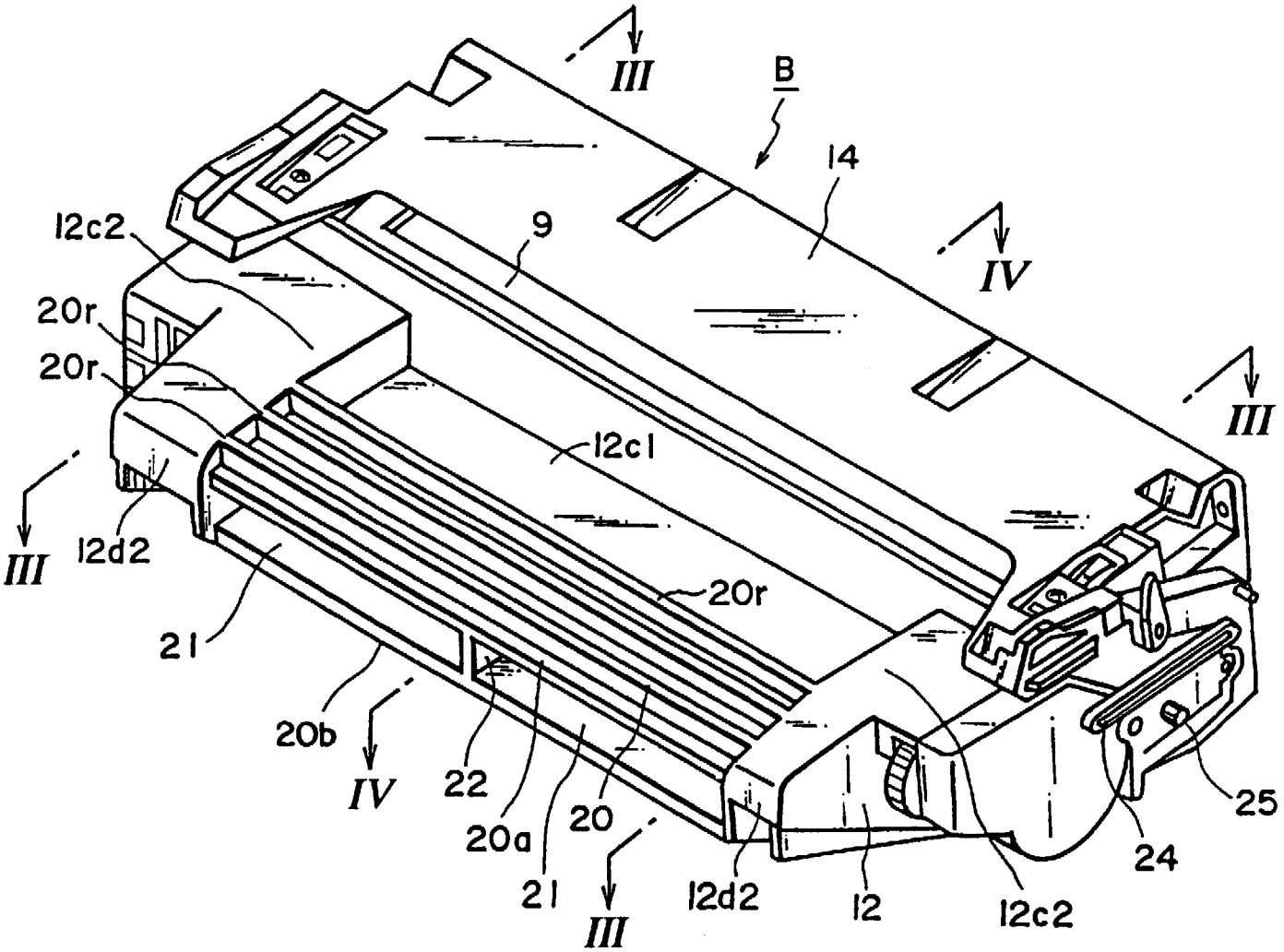
FIG. 1 is a perspective view of a process cartridge according to a preferred embodiment of the present invention.

The present invention will now be explained in connection with a preferred embodiment thereof with reference to the accompanying drawings.

Incidentally, in the embodiment, an elongated toner container (for containing toner) having a toner loading opening and an elongated supply opening capable of being opened to supply the loaded toner and wherein a cross-sectional area of a central portion (in a longitudinal direction) of a developing container is smaller than the cross-sectional areas of end portions (in the longitudinal direction) of the developing container and an inner wall of the longitudinal central portion covers about 1/7 of an area of the toner loading opening will be explained. Further, toner container grip portion has an opening exposed outside and extending in a direction transverse to the supply opening. In addition, as another arrangement, a process cartridge is designed so that the toner is supplied from the toner container, and an image forming apparatus is designed so as to form an image by using such a process cartridge.

With the arrangement as mentioned above, since the cross-sectional area of the longitudinal central portion of the toner container is smaller than the cross-sectional area of the longitudinal end portions of the toner container, the process cartridge has an appearance different from that of a standard cartridge, with the result that such process cartridge can easily be distinguished from the standard cartridge by an operator. Further, in comparison with the cartridges having the uniform cross-sectional area, since the longitudinal central portion of the process cartridge has the smaller cross-sectional area, the toner in the central portion is consumed faster than the other cartridges, with the result that the limit of a toner remaining amount can be detected early.

Further, by modeling the grip portion after the outer appearance of the standard cartridge, the operability for mounting the cartridge to the image forming apparatus can be maintained. In order to make a thickness of the grip portion uniform so that the poor molding or formation of the grip portion is prevented, the grip portion has the opening extending in the direction transverse to the supply opening (unlike to a grip portion having an opening extending in an up-and-down direction with respect to the supply opening), with the result that the strength of a junction portion between the grip portion and the toner containing portion of the cartridge can be maintained adequately.

Now, the preferred embodiment of the present invention will be fully described with reference to the accompanying drawings.

[First Embodiment]

First of all, a process cartridge and an electrophotographic image forming apparatus using such a process cartridge according to a first embodiment of the present invention will be explained referring to the drawings. Incidentally, the entire construction of the process cartridge and the electrophotographic image forming apparatus using such a process cartridge will firstly be described, and then, a toner container used for the process cartridge will be explained.

[Entire Construction of Process Cartridge and Electrophotographic Image Forming Apparatus]

Figure 2:
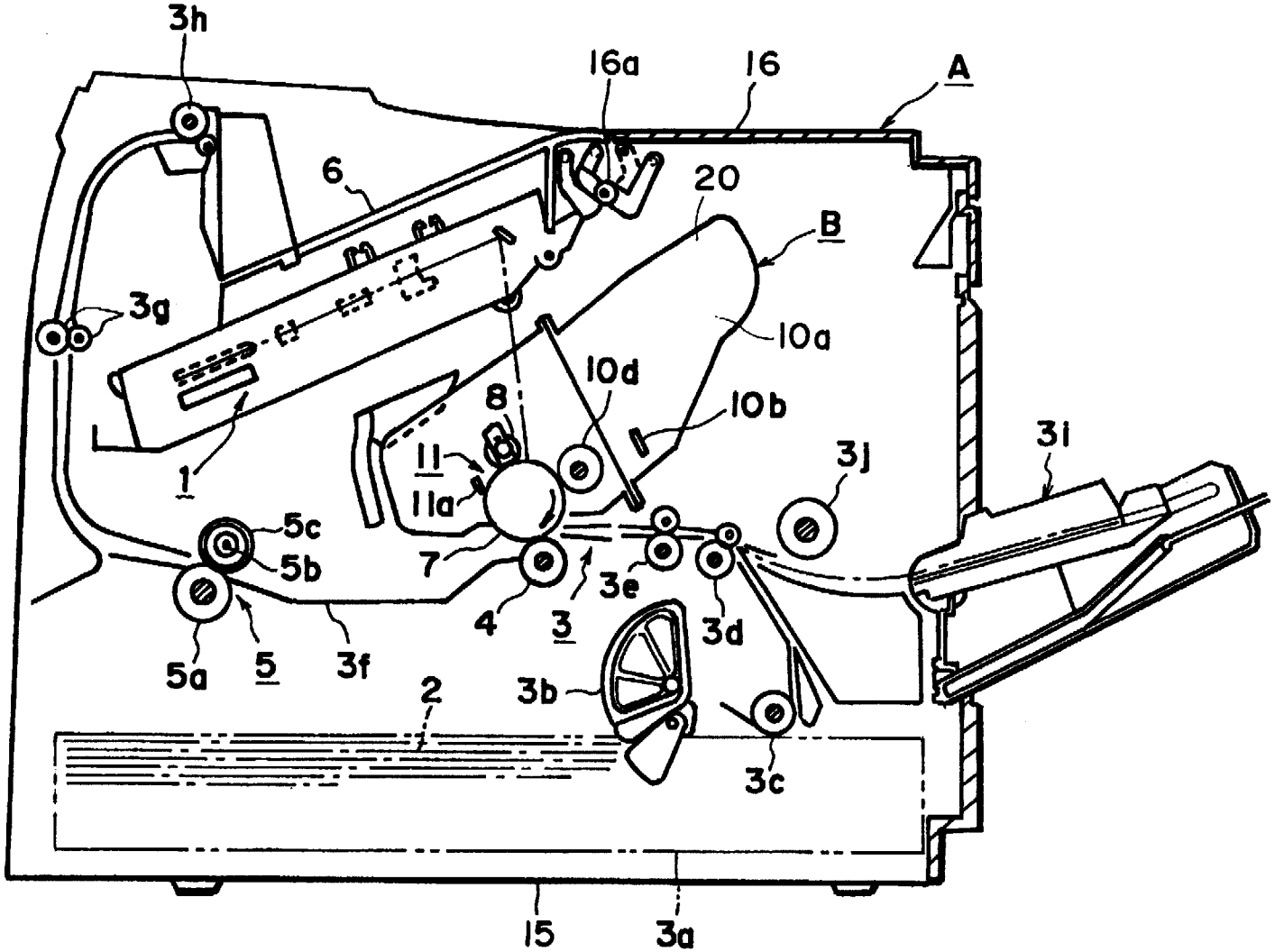
FIG. 2 is a schematic elevational sectional view of an image forming apparatus on which the process cartridge was mounted.

As shown in FIG. 2, in the electrophotographic image forming apparatus (laser beam printer in the illustrated embodiment) A, in response to image information, information light emitted from an optical system 1 is illuminated onto a drum-shaped electrophotographic photosensitive member, thereby forming a latent image on the photosensitive member. Then, the latent image is developed to form a toner image. Synchronous with the formation of the toner image, a recording medium (recording sheet) 2 is separated and supplied one by one from a sheet supply cassette 3*a* by a pick-up roller 3*b* and a convey roller 3*c*. Then, the recording sheet 2 is conveyed by a convey means 3 comprised of a pair of convey rollers 3*d* and a pair of regist rollers 3*e*. Then, the toner image formed on the electrophotographic photosensitive member of a process cartridge is transferred onto the recording sheet 2 by applying voltage to a transfer roller (transfer means) 4. Then, the recording sheet 2 to which the toner image was transferred is conveyed to a fixing means 5 by a convey guide 3*f*. The fixing means 5 comprises a drive roller 5*a*, and a fixing roller 5*c* having a heater 5*b* therein, so that, when the recording sheet 2 is being passed between the rollers 5*a*, 5*c*, the toner image is fixed to the recording sheet by heat and pressure. Then, the recording sheet 2 is discharged onto a discharge portion 6 through a reverse rotation convey path by pairs of discharge rollers 3*g*, 3*h*. Incidentally, the image forming apparatus A also includes a manual insertion tray 3*i* and a manual insertion roller 3*j* to permit the manual sheet insertion or supply.

Figure 3:
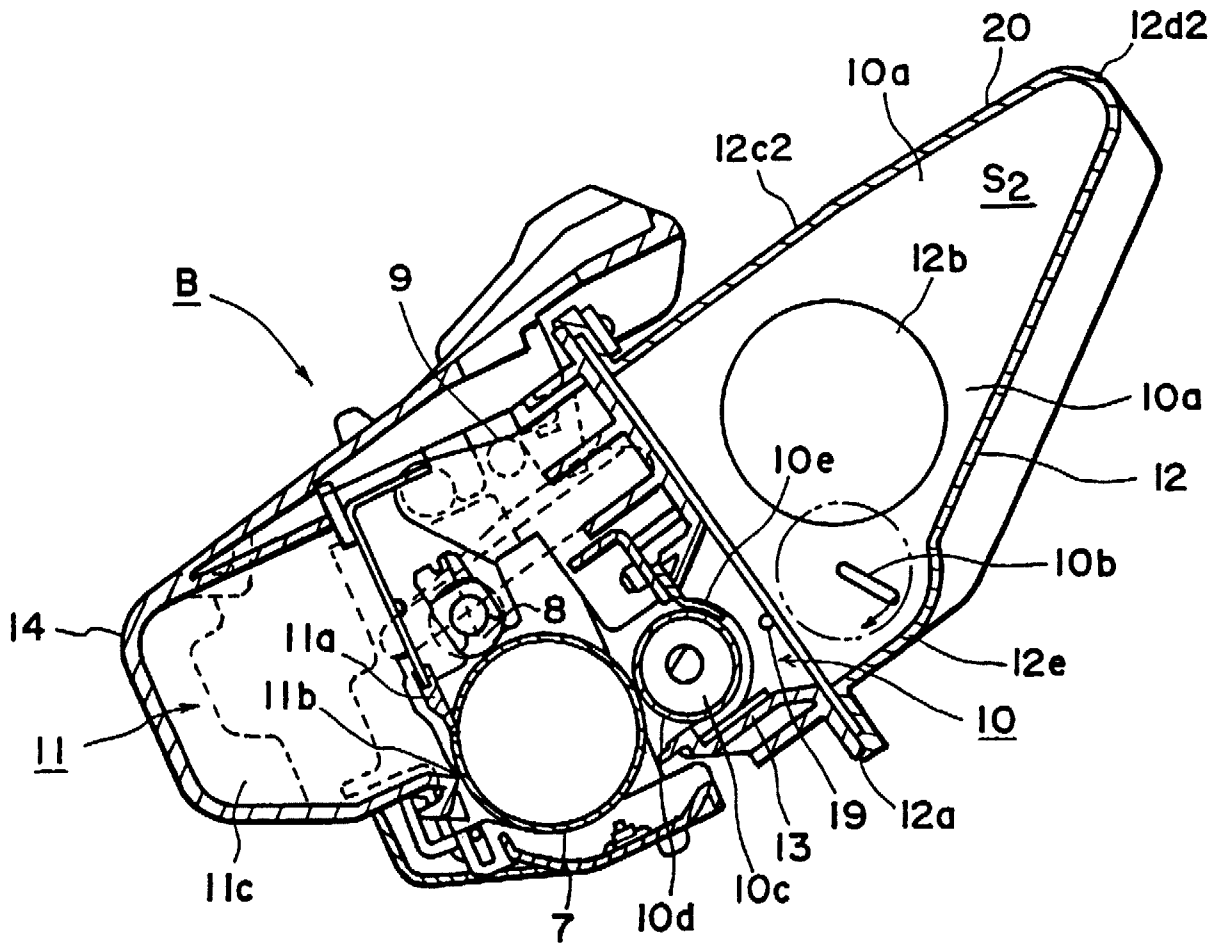
FIG. 3 is a sectional view taken at an end portion of a toner container.
Figure 4:
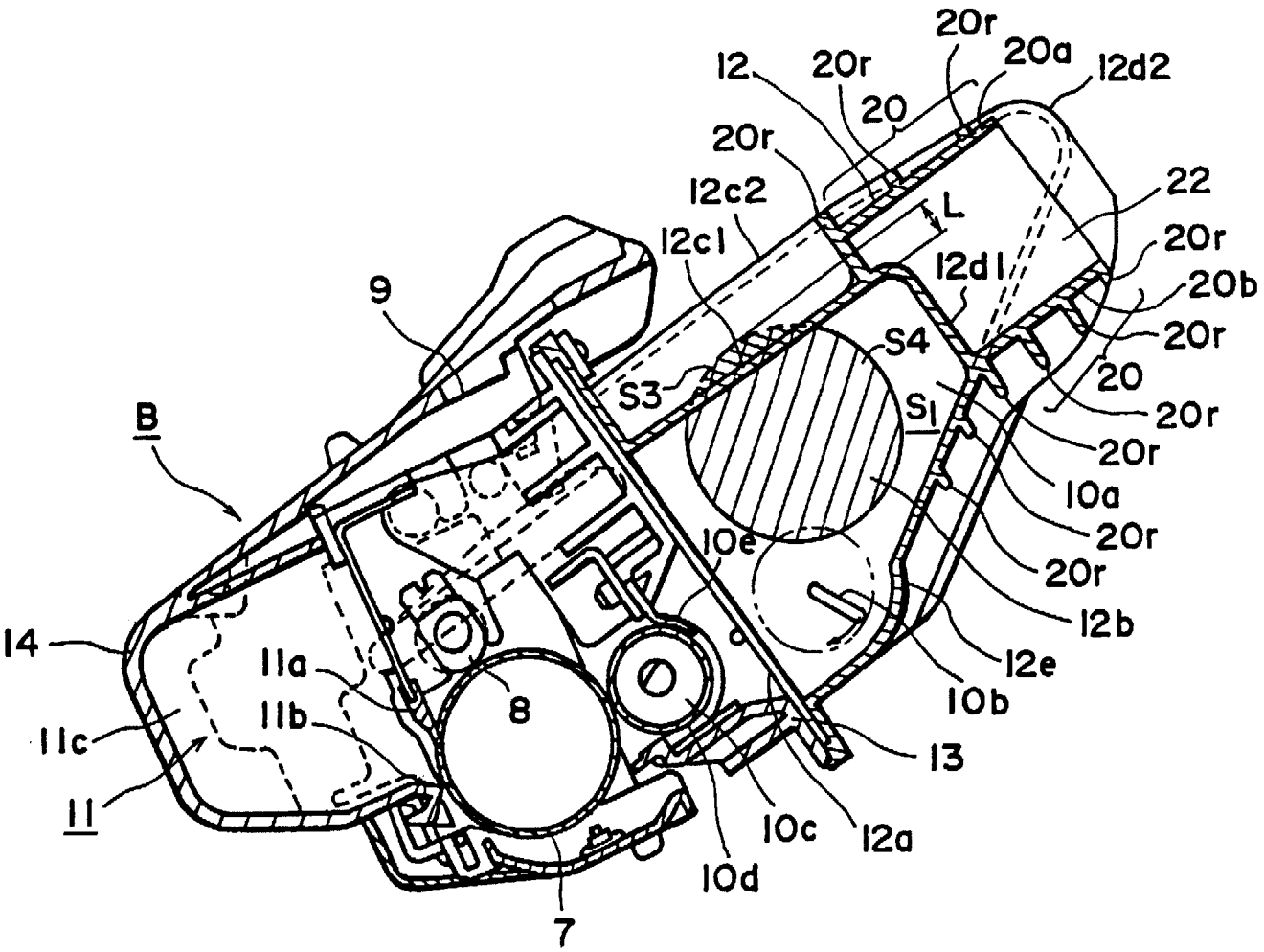
FIG. 4 is a sectional view taken at a central portion of the toner container.

On the other hand, as shown in FIGS. 3 and 4, in the process cartridge B according to the illustrated embodiment, while the drum-shaped electrophotographic photosensitive member (photosensitive drum) 7 is being rotated, a surface of the photosensitive drum 7 is uniformly charged by applying voltage to a charge roller (charge means) 8. Then, as mentioned above, the light from the optical system 1 is illuminated onto the charged surface of the photosensitive drum 7 through an exposure opening 9, thereby forming the latent image on the photosensitive drum 7. Then, the latent image is developed by a developing means 10. Incidentally, as shown in FIGS. 2 to 4, the charge roller 8 is urged against the photosensitive drum 7.

In the developing means 10, the toner in the toner containing portion 10*a* is fed out by a toner feed member 10*b*, and a developing roller (toner bearing member) 10*d* having a fixed magnet 10*c* therein is rotated. As a result, a toner layer is formed on a surface of the developing roller 10*d* by a developing blade 10*e* (in this case, the toner layer is frictionally charged). As the developing roller is rotated, the toner constituting the toner layer is brought to and transferred to the photosensitive drum 7, thereby forming the toner image (visualized image). By applying to the transfer roller 4 the voltage having polarity opposite to that of the toner image, the toner image is transferred onto the recording sheet 2. After the toner image was transferred to the recording sheet 2, residual toner remaining on the photosensitive drum 7 is scraped by a cleaning blade 11*a*. The scraped toner is received by a dip sheet 11*b* and then is collected into a waste toner reservoir 11*c*. In the illustrated embodiment, the residual toner is removed from the photosensitive drum by a cleaning means 11 including the blade 11*a*, dip sheet 11*b* and toner reservoir 11*c*. Incidentally, as shown in FIGS.. 2 to 4, the cleaning blade 11*a* is urged against the photosensitive drum 7.

The above-mentioned various elements such as the photosensitive drum 7 are contained in a cartridge frame obtained by integrally welding a toner container 12 having the toner containing portion 10*a* and a developing frame 13 supporting the developing means 10 (including the developing roller 10*d*, developing blade 10*e* and the like) as an assembly and by securing a cleaning frame 14 supporting the photosensitive drum 7, cleaning blade 11*a* and the like to the assembly (to form the process cartridge), which will be described later. The process cartridge B is removably mounted on a cartridge mounting means provided in a body 15 of the image forming apparatus A.

Figure 5:
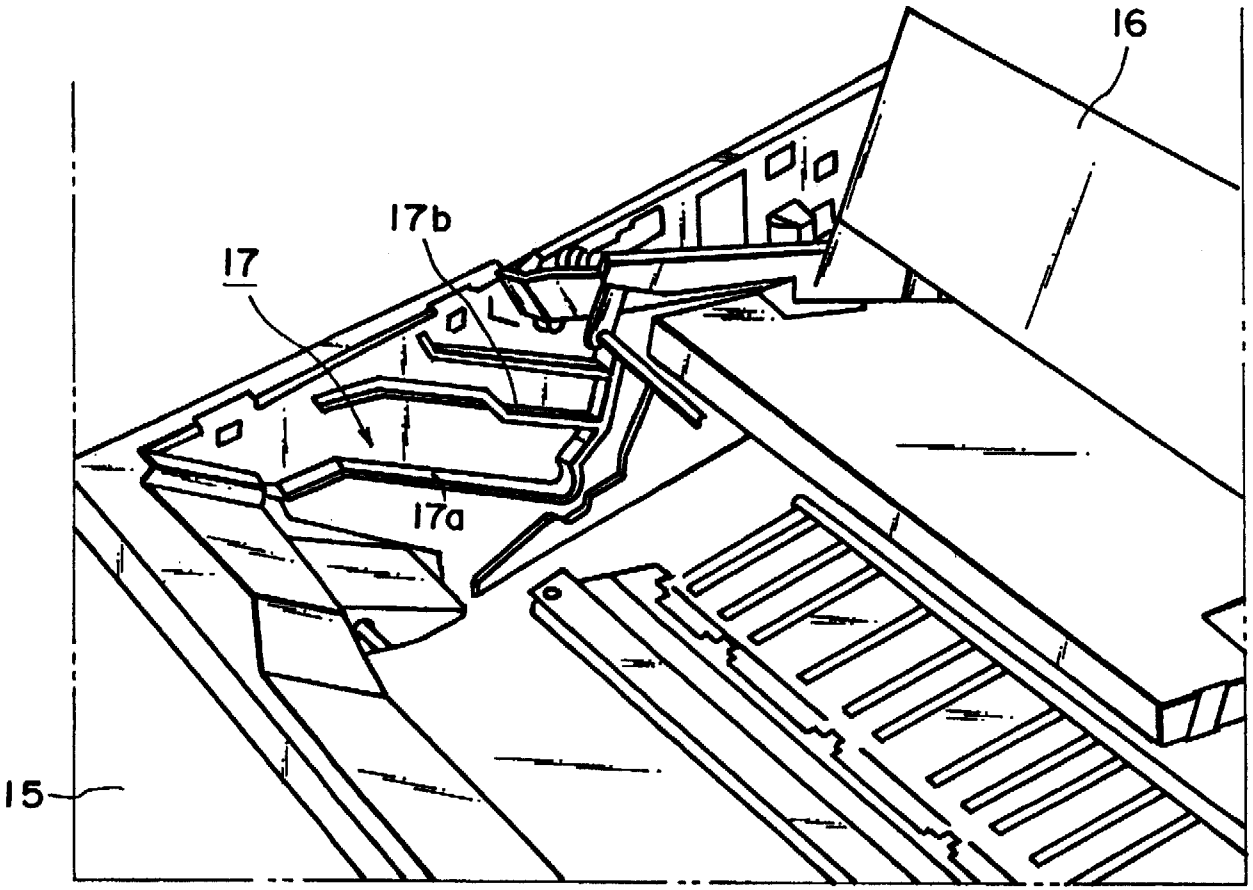
FIG. 5 is an explanatory view showing a mounting structure for the process cartridge.

When an opening/closing member 16 is opened around a shaft 16*a* (FIG. 2), the cartridge mounting means is exposed. As shown in FIG. 5, the cartridge mounting means comprises a pair of opposed cartridge mounting guide members 17 disposed at both left and right sides in a cartridge mounting space (only one guide member is shown in FIG.

5). The left and right guide members 17 have opposed guide portions 17*a*, 17*b* for guiding the inserting of the process cartridge B. When the process cartridge B is inserted along the guide portions 17*a*, 17*b* and the opening/closing member 16 is closed, the process cartridge B is mounted on the image forming apparatus A. When the process cartridge B is mounted on the image forming apparatus A, a drum gear (not shown) secured to one longitudinal end of the photosensitive drum 7 is engaged by a drive transmission gear (not shown) provided on the apparatus body 15, thereby transmitting a driving force to the photosensitive drum 7. Incidentally, in FIG. 1, guides 24, 25 formed on the process cartridge are guided by the guide portions 17*a*, 17*b*. More particularly, the guides 24 are guided by the guide portions 17*b*, and the guides 25 are guided by the guide portions 17*a*.

[Toner Container]

Figure 6:
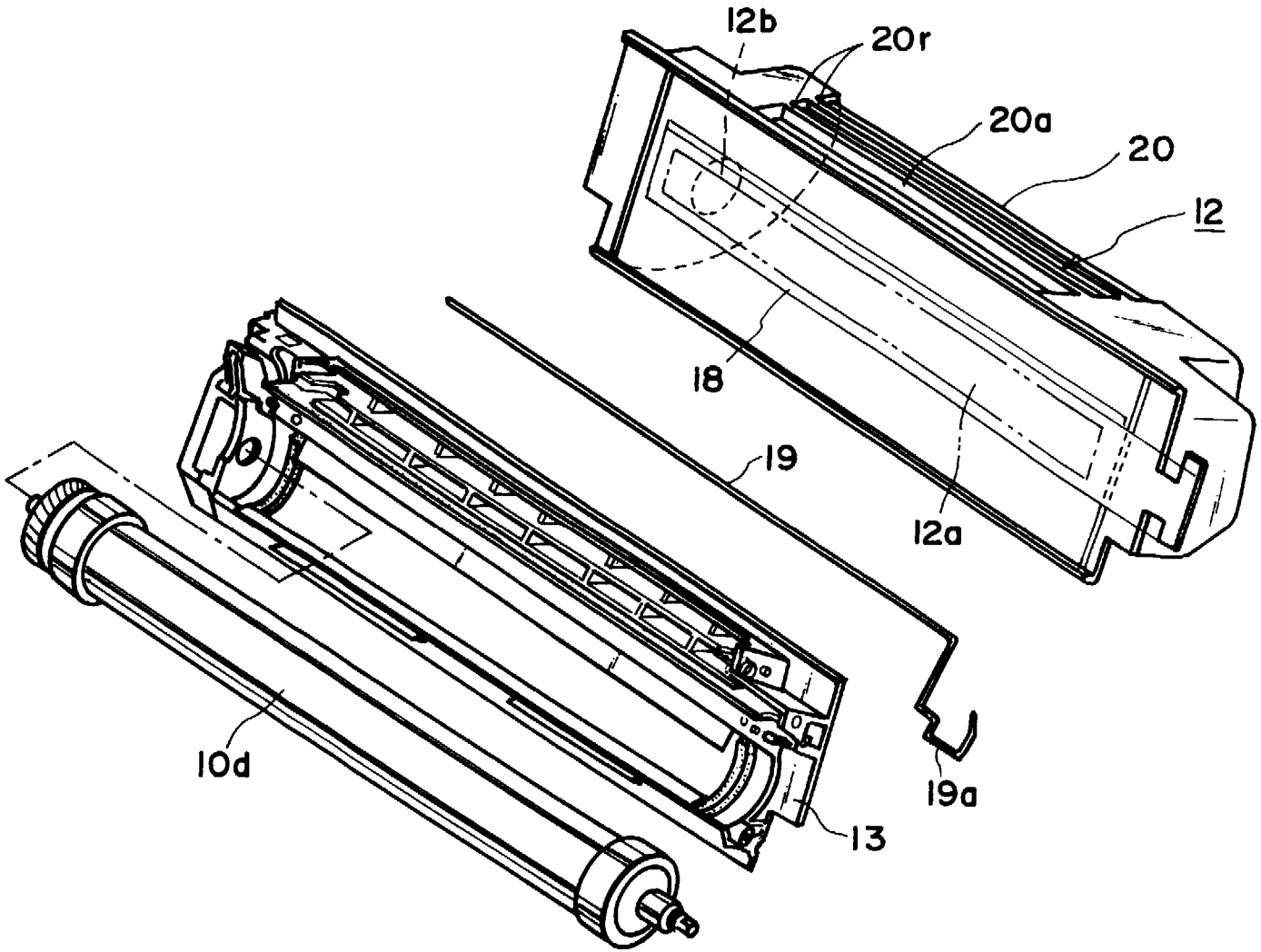
FIG. 6 is an exploded perspective view showing the toner container and a developing frame.

Next, the toner container 12 will be fully described. As shown in FIG. 6, the toner container 12 is an elongated container having an elongated toner supply opening 12*a* extending in a longitudinal direction of the container. The toner supply opening 12*a* is closed by a peelable film-like seal member 18 by heat seal. Further, a toner loading opening 12*b* is provided at one longitudinal end portion of the toner container 12. After the toner is loaded through the toner loading opening 12*b*, the toner loading opening 12*b* is closed by a cap (not shown).

Further, the developing frame 13 is contacted to a surface of the toner container 12 in which the toner supply opening 12*a* is formed, and is joined to the container 12 by welding upper and lower longitudinal edge portions of the members 13, 12 together. By attaching the developing roller 10*d* and the developing blade 10*e* to the developing frame 13, the developing means is formed.

Incidentally, before the developing frame 13 is joined to the toner container 12, a seal member 18 sealing the toner supply opening 12*a* is folded back near one longitudinal end of the supply opening and a free end of the folded seal member is protruded outside beyond the other longitudinal end of the supply opening. Accordingly, after the developing frame 13 is joined to the toner container 12, when the free end of the seal member 18 is pulled outwardly, the seal member 18 is peeled from the toner supply opening 12*a*, thereby opening it. Incidentally, as can be seen from FIGS. 3, 4 and 6, the toner contained in the toner container 12 is supplied to the developing means through the supply opening 12*a*.

Further, when the developing frame 13 is joined to the toner container 12, an antenna line (toner remaining amount detection member) 19 comprised of a conductive rod is disposed between the developing frame 13 and the toner container. The antenna line 19 extends in parallel with the longitudinal direction of the toner supply opening 12*a* and one end 19*a* of the antenna line is exposed outside.

When the process cartridge B is mounted on the image forming apparatus A, the exposed end of the antenna line 19 is contacted with a contact provided in the image forming apparatus. In this case, since the electrostatic capacity between the developing roller 10*d* and the antenna line 19 is changed in dependence upon an amount of toner existing between the developing roller 10*d* and the antenna line 19, by detecting the change in the electrostatic capacity, the lower limit of the toner amount can be detected. The detected result is displayed on a display (not shown) as "no toner".

As shown in FIG. 1, the toner container 12 is provided at its central upper surface with a recess 12*c*1 so that the upper surface at the central portion is positioned lower than the upper surface at both end portions. The internal space of the toner container at the longitudinal central portion thereof differs from those at the longitudinal both end portions. More particularly, a cross-sectional view (taken along a width-wise direction of the toner container) of the toner container 12 at the longitudinal end portions thereof (taken along the lines III—III in FIG. 1) is shown in FIG. 3. On the other hand, a cross-sectional view of the toner container 12 at the longitudinal central portion thereof (taken along the line IV—IV in FIG. 1) is shown in FIG. 4. As shown in FIGS. 3 and 4, the cross-sectional area of the toner containing portion 10*a* at the longitudinal central portion thereof differs from those at the longitudinal end portions thereof.

In the conventional process cartridges, the internal space of a toner container has a uniform cross-sectional area through the entire length. To the contrary, in the process cartridge B according to the illustrated embodiment of the present invention, the cross-sectional area of the toner containing portion 10*a* at the longitudinal central portion thereof is smaller than those at the longitudinal end portions thereof. Thus, as shown in FIG. 4, an upper wall 12*c*1 of the longitudinal central portion of the toner container is recessed below upper walls 12*c*2 of the longitudinal end portions of the toner container, and a rear wall 12*d*1 of the central portion opposed to the toner supply opening 12*a* is positioned nearer than rear walls 12*d*2 of the end portions with respect to the toner supply opening 12*a*.

With this arrangement, in the illustrated embodiment, a ratio between the cross-sectional area $S_1$ of the longitudinal central portion of the toner container and the cross-sectional area $S_2$ of each longitudinal end portion is selected to 2:3.

Further, the central upper wall 12*c*1 is protruded downwardly below upper portion of the loading opening 12*b*. However, the central upper wall 12*c*1 is protruded downwardly to the extent that the upper wall does not make the loading of the toner through the loading opening 12*b* difficult (in the illustrated embodiment, a distance L between an upper edge of the loading opening 12*b* and the upper wall 12*c*1 is selected to about 7.5 mm). In order that the upper wall 12*c*1 does not make the loading of the toner, when an area of an upper portion of the loading opening 12*b* covered by the upper wall 12*c*1 is $S_3$ and the entire area of the loading opening 12*b* is $S_4$, it was found that, when $S_3/S_4 \leqq 1/7$, the loading of the toner does not made difficult.

Incidentally, since a lower wall 12*e* of the toner containing portion contributes to one of developing conditions of the process cartridge, such a lower wall is uniformly formed through the entire length of the toner containing portion.

Further, when the process cartridge B is mounted to the image forming apparatus A, a grip portion 20 (FIGS. 1 and 4) for facilitating the transportation of the process cartridge B is provided on the toner containing portion 10*a* itself. In comparison with grip portions of the conventional process cartridge, the grip portion 20 is somewhat shorter in a direction opposing to the toner supply opening 12*a*. Incidentally, as can be understood from FIGS. 1 to 4, by gripping the grip portion 20, the operator can mount or dismount the process cartridge B with respect to the image forming apparatus along a direction transverse to the longitudinal direction of the photosensitive drum 7.

In order to prevent the poor molding or formation of the grip portion 20, the grip portion is provided with not only an opening 21 extending in an up-and-down direction but also an opening 21 extending in the direction transverse to the supply opening 12*a* (i.e., direction opposing to the supply opening), so that the grip portion is provided with the interposition of the opening 21. The opening is divided into two sections by a central partition rib 22 and the thickness is maintained substantially uniformly. That is to say, as can be seen from FIG. 1, the opening 21 is formed between an upper surface 20*a* and a lower surface 20*b* of the grip portion 20 and extends along the longitudinal direction of the toner containing portion 10*a* (toner container 12) and is also exposed outside. The grip portion 20 is positioned between one end and the other end of the toner containing portion 10*a*. And, in the upper and lower surfaces 20*a*, 20*b*, there are provided a plurality of ribs 20*r* extending along the direction transverse to the cartridge mounting direction (to the apparatus body 15), as can be seen in FIGS. 1 and 4.

After the process cartridge B was mounted on the image forming apparatus A, when the image formation is started, as the toner in the toner container 12 is gradually decreased, since the cross-sectional area of the longitudinal central portion is smaller than those of the longitudinal end portions, the toner amount in the longitudinal central portion becomes smaller than those in the longitudinal end portions. Thus, in comparison with the conventional process cartridge having a substantially uniform cross-sectional area to make the toner amount uniform through the entire length, when the "no toner" condition is detected by the antenna line 19, the toner remaining amount in the process cartridge according to the illustrated embodiment of the present invention becomes greater than the toner remaining amount in the conventional process cartridge. Thus, in the process cartridge B according to the illustrated embodiment, even after the "no toner" condition was detected, the greater number of copies can be obtained by the remaining toner in comparison with the conventional process cartridge, thereby providing an adequate time for preparing a new cartridge to be exchanged.

Further, in an assembling operation, unlike the standard cartridge, since the process cartridge according to the illustrated embodiment has the concave upper surface, the operator can easily distinguish the process cartridge from the other without marking any labels. Thus, there is less chance that the process cartridge having different toner loading amount is mounted to the image forming apparatus erroneously and any checking process is not required, thereby easily assembling the desired cartridge to the image forming apparatus.

In addition, since the configuration of the longitudinal end portions of the derivative cartridge according to the illustrated embodiment is the same as that of the standard cartridge, the drive transmitting members and the like incorporated into the longitudinal end portions can be manufactured and assembled in the same production line as the standard cartridge.

[Other Embodiments]

In the above-mentioned embodiment, while an example that the toner container is integrally jointed to the developing frame to provide the developing means was explained, the toner container may be removably connected to the developing frame to form a process cartridge.

While the process cartridge according to the illustrated embodiment served to form a mono-color image, the present invention can be applied to a cartridge in which a plurality of developing means are provided to form a multi-color image (for example, two-color image, three-color image or full-color image).

Further, the developing method may be a conventional two-component magnetic brush developing method, cascade developing method, touch-down developing method, cloud developing method or other any developing method.

The electrophotographic photosensitive member is not limited to the photosensitive drum. For example, photoconductive body can be used as the photosensitive body. In this case, the photo-conductive body may be, for example, amorphous silicone, amorphous selenium, zinc oxide, titanium oxide or organic photo-conductive (OPC) material. Further, the photosensitive body may be mounted on a rotary member such as a drum and a endless belt, or on a sheet. Generally, the photosensitive body is mounted on the drum-shaped rotary member or the belt-shaped rotary member. For example, the drum-shaped photosensitive member is constituted by a cylinder made of aluminum or alloy thereof, and a photo-conductive layer coated or deposited on the cylinder.

In the illustrated embodiment, while an example that the charge means of so-called contact charging type is used was explained, any conventional charge means can be utilized. For example, a U-shaped three-wall formed from a tangsten wire enclosed by an aluminium shield may be used, and positive or negative ions generated by applying high voltage to the tangsten wire may be transferred onto the surface of the photosensitive drum, thereby uniformly charging the photosensitive drum.

Incidentally, the charge means may be of blade (charging blade) type, pad type, block type, rod type or wire type, as well as the above-mentioned roller type. Further, the cleaning means for removing the residual toner from the photosensitive drum may comprise a blade, a fur brush or a magnet brush.

The above-mentioned process cartridge includes at least the developing means, but a process cartridge may include an electrophotographic photosensitive member and at least one process means. And, the process means is not limited to the developing means. Thus, the process cartridge may incorporate therein a developing means, an electrophotographic photosensitive member, a charge means and a cleaning means as a unit which can be removably mounted to an image forming apparatus, or may incorporate therein a developing means, an electrophotographic photosensitive member, and a charge means or a cleaning means as a unit which can be removably mounted to an image forming apparatus, or may incorporate therein a developing means and an electrophotographic photosensitive member as a unit which can be removably mounted to an image forming apparatus.

In the above-mentioned embodiments, while an example that the image forming apparatus is embodied as the laser beam printer was explained, the present invention is not limited to such an example, but, the image forming apparatus may be embodied as an electrophotographic copying machine, a facsimile system or a word processor.

In the illustrated embodiments, since a certain number of copies can be recorded even after the "no toner" condition was detected, an adequate time for preparing a new cartridge to be exchanged can be preserved.

Further, in an assembling operation, since the process cartridge according to the illustrated embodiment has the configuration different from the standard cartridge, the operator can easily distinguish the process cartridge from the other without marking any labels. Thus, there is less chance that the process cartridge having different toner loading amount is mounted to the image forming apparatus erroneously and any checking process is not required, thereby easily assembling the desired cartridge to the image forming apparatus.

Further, the cartridge according to the illustrated embodiments can be manufactured in the same production line as the standard cartridge.

Furthermore, by modeling the grip portion after the outer appearance of the standard cartridge, the operability for mounting the cartridge to the image forming apparatus can be maintained. To make a thickness of the grip portion uniform so that the poor molding or formation of the grip portion is prevented, the grip portion has the opening extending in the direction transverse to the supply opening (unlike to a grip portion having an opening extending in an up-and-down direction with respect to the supply opening), with the result that the strength of a junction portion between the grip portion and the toner containing portion of the cartridge can be maintained adequately.

As mentioned above, according to the present invention, the operator can recognize the loaded toner amount from the shape of the cartridge.

What is claimed is:

1. A process cartridge removably mounted to a main body of an image forming apparatus, comprising:

an electrophotographic photosensitive member;

process means acting on said electrophotographic photosensitive member;

a toner containing portion for containing a toner to be used for developing a latent image formed on said electrophotographic photosensitive member;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body;

wherein the mount direction and a dismount direction of said process cartridge from the main body of said image forming apparatus are transverse to a longitudinal direction of said electrophotographic photosensitive member.

2. A process cartridge according to claim 1, wherein said toner containing portion has an upper wall at a longitudinal central portion thereof positioned lower than upper walls at longitudinal end portions thereof, and a rear wall of said longitudinal central portion is positioned nearer than rear walls of said longitudinal end portions with respect to a toner supply opening; and each of said upper walls is positioned upwardly when said process cartridge is mounted on the main body of said image forming apparatus, the toner supply opening is an opening for supplying the contained toner to said electrophotographic photosensitive member, and each of said rear walls is positioned in an opposed relation to the toner supply opening; and wherein said grip portions are positioned between said longitudinal ends and behind said rear wall of said longitudinal central portion in the mount direction.

3. A process cartridge according to claim 1 or 2, wherein a cross-sectional area of the interior of said longitudinal central portion of said toner containing portion is smaller than a cross-sectional area of each of said longitudinal end portions.

4. A process cartridge according to claim 3, wherein a ratio between the cross-sectional area of said longitudinal central portion and the cross-sectional area of each of said longitudinal end portions is 2:3.

5. A process cartridge according to claim 2, wherein said upper wall of said longitudinal central portion is recessed in said toner containing portion so as to overlap with a toner loading opening through which the toner is loaded into said toner containing portion.

6. A process cartridge according to claim 5, wherein an overlapped area between said upper wall of said longitudinal central portion and the toner loading opening is equal to or smaller than 1/7 of the entire area of the toner loading opening.

7. A process cartridge according to claim 5, wherein said grip portions are provided with a plurality of ribs extending in a direction transverse to the mount direction.

8. A process cartridge according to claim 1 or 5, wherein a partition member is provided within the cavity between said upper and lower surfaces, and said partition member is disposed at a longitudinal central portion of said toner containing portion to divide said cavity extending in the longitudinal direction of said toner containing portion.

9. A process cartridge according to claim 1 or 2, wherein a cross-sectional area of the interior of said longitudinal central portion of said toner containing portion is smaller than a cross-sectional area of each of said longitudinal end portions.

10. A toner frame according to claim 9, wherein a ratio between the cross-sectional area of said longitudinal central portion and the cross-sectional area of each of said longitudinal end portions is 2:3.

11. A process cartridge according to claim 1, wherein the process cartridge incorporates therein said electrophotographic photosensitive member, and at least one of a developing means, a charge means and a cleaning means acting as said process means as a unit which can removably be mounted to the main body at said image forming apparatus.

12. A process cartridge removably mounted to a main body of an image forming apparatus, comprising:

an electrophotographic photosensitive drum;

process means acting on said electrophotographic photosensitive drum;

a toner containing portion for containing toner to be used for developing a latent image formed on said electrophotographic photosensitive drum, said toner containing portion having an upper wall at a longitudinal central portion thereof positioned lower than upper walls at longitudinal end portions thereof, and a rear wall of said longitudinal central portion positioned nearer than rear walls of said longitudinal end portions with respect to a toner supply opening, and each of said upper walls is positioned upwardly when said process cartridge is mounted on the main body of said image forming apparatus, the toner supply opening is an opening for supplying the contained toner to said electrophotographic photosensitive drum, and each of said rear walls is positioned in an opposed relation to said toner supply opening;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body;

wherein said grip portions are positioned between said longitudinal ends and behind said rear wall of said longitudinal central portion in the mount direction;

wherein the mount direction and a dismount direction of said process cartridge from the main body of said image forming apparatus are transverse to a longitudinal direction of said electrophotographic photosensitive member.

13. A process cartridge according to claim 12, wherein a cross-sectional area of the interior of said longitudinal central portion of said toner containing portion is smaller than a cross-sectional area of each of said longitudinal end portions.

14. A process cartridge according to claim 13, wherein a ratio between the cross-sectional area of said longitudinal central portion and the cross-sectional area of each of said longitudinal end portions is 2:3.

15. A process cartridge according to claim 12, wherein said upper wall of said longitudinal central portion is recessed in said toner containing portion so as to overlap with a toner loading opening through which the toner is loaded into said toner containing portion.

16. A process cartridge according to claim 15, wherein an overlapped area between said upper wall of said longitudinal central portion and the toner loading opening is equal to or smaller than 1/7 of the entire area of the toner loading opening.

17. A process cartridge according to claim 15, wherein said grip portions are provided with a plurality of ribs extending in a direction transverse to the mount direction.

18. A process cartridge according to claim 12 or 15, wherein a partition member is provided within the cavity between said upper and lower surfaces, and said partition member is disposed at a longitudinal central portion of said toner containing portion to divide said cavity extending in the longitudinal direction of said toner containing portion.

19. A process cartridge according to claim 12, wherein the process cartridge incorporates therein said electrophotographic photosensitive drum, and at least one of a developing means, a charge means and a cleaning means acting as said process means as a unit which can removably be mounted to the main body of said image forming apparatus.

20. A process cartridge removably mounted to a main body of an image forming apparatus, comprising:

(a) a cleaning frame for supporting an electrophotographic photosensitive drum, charge means urged against said electrophotographic photosensitive drum to charge it, and a cleaning blade urged against said electrophotographic photosensitive drum to remove residual toner remaining thereon;

(b) a developing frame for supporting a developing roller for developing a latent image formed on said electrophotographic photosensitive drum;

(c) a toner frame for supporting a toner containing portion for containing toner used by said developing roller to develop the latent image, said toner containing portion having an upper wall at a longitudinal central portion thereof positioned lower than upper walls at longitudinal end portions thereof, and a rear wall of said longitudinal central portion positioned nearer than rear walls of said longitudinal end portions with respect to a toner supply opening, and each of said upper walls is positioned upwardly when said process cartridge is mounted on the main body of said image forming apparatus, the toner supply opening is an opening for supplying the contained toner to said electrophotographic photosensitive drum, and each of said rear walls is positioned in an opposed relation to the toner supply opening;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body;

wherein said grip portions are positioned between said longitudinal ends and behind said rear wall of said longitudinal central portion in the mount direction;

said grip portions being provided with a plurality of ribs extending in a direction transverse to the mount direction, and a partition member is provided within the cavity between said upper and lower surfaces, said partition member being disposed at the longitudinal central portion of said electrophotographic photosensitive drum to divide said cavity extending in said longitudinal direction; and (d) said developing frame and said toner frame are integrally joined to each other to form a developing unit which is pivotally connected to said cleaning frame relative to each other, and the mount direction and a dismount direction of said process cartridge from the main body of said image forming apparatus are transverse to the longitudinal direction of said electrophotographic photosensitive drum.

21. A process cartridge according to claim 20, wherein a ratio between a cross-sectional area of said longitudinal central portion and a cross-sectional area of each of said longitudinal end portions is 2:3.

22. A process cartridge according to claim 20, wherein said upper wall of said longitudinal central portion is recessed in said electrophotographic photosensitive drum so as to overlap with a toner loading opening through which the toner is loaded into said toner containing portion.

23. A process cartridge according to claim 22, wherein an overlapped area between said upper wall of said longitudinal central portion and the toner loading opening is equal to or smaller than 1/7 of the entire area of the toner loading opening.

24. A toner frame to be used with a process cartridge which includes an electrophotographic photosensitive member and process means acting on said electrophotographic photosensitive member and which is mounted to and dismounted from the main body of image forming apparatus along a direction transverse to a longitudinal direction of said electrophotographic photosensitive member, comprising:

a toner containing portion for containing toner used for developing a latent image formed on said electrophotographic photosensitive member;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body.

25. A toner frame according to claim 24, wherein said toner containing portion has an upper wall at a longitudinal central portion thereof positioned lower than upper walls at longitudinal end portions thereof, and a rear wall of said longitudinal central portion is positioned nearer than rear walls of said longitudinal end portions with respect to a toner supply opening; and each of said upper walls is positioned upwardly when the process cartridge is mounted on the main body of the image forming apparatus, the toner supply opening is an opening for supplying the contained toner to said electrophotographic photosensitive member, and each of said rear walls is positioned in an opposed relation to the toner supply opening; and wherein said grip portions are positioned between said longitudinal ends and behind said rear wall of said longitudinal central portion in the mount direction.

26. A toner frame according to claim 25, wherein said upper wall of said longitudinal central portion is recessed in said toner containing portion so as to overlap with a toner loading opening through which the toner is loaded into said toner containing portion.

27. A toner frame according to claim 26, wherein an overlapped area between said upper wall of said longitudinal central portion and the toner loading opening is equal to or smaller than 1/7 of the entire area of the toner loading opening.

28. A toner frame according to claim 26, wherein said grip portions are provided with a plurality of ribs extending in a direction transverse to the mount direction.

29. A toner frame according to claim 24 or 26, wherein a partition member is provided within said cavity between said upper and lower surfaces, and said partition member is disposed at a longitudinal central portion of said toner containing portion to divide said cavity extending in the longitudinal direction of said toner containing portion.

30. A toner frame according to claim 24, wherein the process cartridge incorporates therein said electrophotographic photosensitive member, and at least one of a developing means, a charge means and a cleaning means acting as said process means as a unit which can removably be mounted to the main body of said image forming apparatus.

31. A toner frame to be used with a process cartridge which includes an electrophotographic photosensitive member and process means acting on said electrophotographic photosensitive member and which is mounted to and dismounted from a main body of an image forming apparatus along a direction transverse to a longitudinal direction of said electrophotographic photosensitive member, comprising:

a toner containing portion for containing toner to be used for developing a latent image formed on said electrophotographic photosensitive member, said toner containing portion having an upper wall at a longitudinal central portion thereof positioned lower than upper walls at longitudinal end portions thereof, and a rear wall of said longitudinal central portion positioned nearer than rear walls of said longitudinal end portions with respect to a toner supply opening, and wherein each of said upper walls is positioned upwardly when the process cartridge is mounted on the main body of the image forming apparatus, the toner supply opening is an opening for supplying the contained toner to said electrophotographic photosensitive member, and each of said rear walls is positioned in an opposed relation to the toner supply opening;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body;

wherein said grip portions are positioned between said longitudinal ends and behind said rear wall of said longitudinal central portion in the mount direction.

32. A toner frame according to claim 31, wherein a cross-sectional area of the interior of said longitudinal central portion of said toner containing portion is smaller than a cross-sectional area of each of said longitudinal end portions.

33. A toner frame according to claim 32, wherein a ratio between the cross-sectional area of said longitudinal central portion and the cross-sectional area of each of said longitudinal end portions is 2:3.

34. A toner frame according to claim 31, wherein said upper wall of said longitudinal central portion is recessed in said toner containing portion so as to overlap with a toner loading opening through which the toner is loaded into said toner containing portion.

35. A toner frame according to claim 34, wherein an overlapped area between said upper wall of said longitudinal central portion and the toner loading opening is equal to or smaller than 1/7 of the entire area of the toner loading opening.

36. A toner frame according to claim 34, wherein said grip portions are provided with a plurality of ribs extending in a direction transverse to the mount direction.

37. A toner frame according to claim 31 or 34, wherein a partition member is provided within the cavity between said upper and lower surfaces, and said partition member is disposed at a longitudinal central portion of said toner containing portion to divide said cavity extending in the longitudinal direction of said toner containing portion.

38. A toner frame according to claim 31, wherein the process cartridge incorporates therein said electrophotographic photosensitive member, and at least one of a developing means, a charge means and a cleaning means acting as said process means as a unit which can removably be mounted to the main body of said image forming apparatus.

39. A toner frame to be used with a process cartridge which includes (a) a cleaning frame for supporting an electrophotographic photosensitive drum, charge means urged against said electrophotographic photosensitive drum to charge it, and a cleaning blade urged against said electrophotographic photosensitive drum to remove residual toner remaining thereon, and (b) a developing frame for supporting a developing roller for developing a latent image formed on said electrophotographic photosensitive drum and which can be mounted to and dismounted from a main body of an image forming apparatus along a direction transverse to a longitudinal direction of said electrophotographic photosensitive drum, comprising:

a toner containing portion for containing toner to be used by said developing roller to develop the latent image, said toner containing portion having an upper wall at a longitudinal central portion thereof positioned lower than upper walls at longitudinal end portions thereof, and a rear wall of said longitudinal central portion positioned nearer than rear walls of said longitudinal end portions with respect to a toner supply opening, and wherein each of said upper walls is positioned upwardly when the process cartridge is mounted on the main body of the image forming apparatus, the toner supply opening is an opening for supplying the contained toner to said electrophotographic photosensitive drum, and said rear walls are positioned in an opposed relation to said toner supply opening;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body;

wherein said grip portions are positioned between said longitudinal ends and behind said rear wall of said longitudinal central portion in the mount direction;

said grip portions being provided with a plurality of ribs extending in a direction transverse to the mount direction, and a partition member is provided within the cavity between said upper and lower surfaces, said partition member being disposed at a longitudinal central portion of said electrophotographic photosensitive drum to divide said cavity extending in said longitudinal direction; and said developing frame and said toner frame are integrally joined to each other to form said process cartridge.

40. A toner frame according to claim 39, wherein a ratio between a cross-sectional area of said longitudinal central portion and a cross-sectional area of each of said longitudinal end portions is 2:3.

41. A toner frame according to claim 40, wherein said upper wall of said longitudinal central portion is recessed in said toner containing portion so as to overlap with a toner loading opening through which the toner is loaded into said toner containing portion.

42. A toner frame according to claim 41, wherein an overlapped area between said upper wall of said longitudinal central portion and the toner loading opening is equal to or smaller than 1/7 of the entire area of the toner loading opening.

43. An image forming apparatus, to a main body of which a process cartridge is removably mounted and which forms an image on a recording medium, comprising:

(a) mounting means for removably mounting a process cartridge including an electrophotographic photosensitive member;

process means acting on said electrophotographic photosensitive member;

a toner containing portion for containing toner to be used for developing a latent image formed on said electrophotographic photosensitive member;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body;

wherein the mount direction and a dismount direction of said process cartridge from the main body of said image forming apparatus are transverse to a longitudinal direction of said electrophotographic photosensitive member; and (b) convey means for conveying the recording medium.

44. An image forming apparatus, to a main body of which a process cartridge is removably mounted and which forms an image on a recording medium, comprising:

(a) mounting means for removably mounting a process cartridge including an electrophotographic photosensitive drum;

process means acting on said electrophotographic photosensitive drum;

a toner containing portion for containing toner to be used for developing a latent image formed on said electrophotographic photosensitive drum, said toner containing portion having an upper wall at a longitudinal central portion thereof positioned lower than upper walls at longitudinal end portions thereof, a rear wall of said longitudinal central portion positioned nearer than rear walls of said longitudinal end portions with respect to a toner supply opening, and wherein each of said upper walls is positioned upwardly when the process cartridge is mounted on the main body of said image forming apparatus, the toner supply opening is an opening for supplying the contained toner to said electrophotographic photosensitive member, and each of said rear walls is positioned in an opposed relation to the toner supply opening;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body;

wherein said grip portions are positioned between said longitudinal ends and behind said rear wall of said longitudinal central portion in the mount direction;

wherein the mount direction and a dismount direction of said process cartridge from the main body of said image forming apparatus are transverse to a longitudinal direction of said electrophotographic photosensitive member; and (b) convey means for conveying the recording medium.

45. An image forming apparatus, to a main body of which a process cartridge is removably mounted and which forms an image on a recording medium, comprising:

(i) mounting means for removably mounting a process cartridge including:

(a) a cleaning frame for supporting an electrophotographic photosensitive drum, charge means urged against said electrophotographic photosensitive drum to charge it, and a cleaning blade urged against said electrophotographic photosensitive drum to remove residual toner remaining thereon;

(b) a developing frame for supporting a developing roller for developing a latent image formed on said electrophotographic photosensitive drum;

(c) a toner frame for supporting a toner containing portion for containing toner to be used by said developing roller to develop the latent image, said toner containing portion having an upper wall at a longitudinal central portion thereof positioned lower than upper walls at longitudinal end portions thereof, and a rear wall of said longitudinal central portion positioned nearer than rear walls of said longitudinal end portions with respect to a toner supply opening, and each of said upper walls is positioned upwardly when the process cartridge is mounted on the main body of said image forming apparatus, the toner supply opening is an opening for supplying the contained toner to said electrophotographic photosensitive drum, and each of said rear walls is positioned in an opposed relation to said toner supply opening;

a first grip portion provided on a surface forming an upper surface of said toner containing portion when said process cartridge is mounted to the main body; and a second grip portion provided on a surface forming a lower surface of said toner containing portion when said process cartridge is mounted to the main body;

a cavity being formed between said first grip portion and said second grip portion and recessed into said toner containing portion, so as to be located upstream of said toner containing portion in a mount direction of said process cartridge to the main body;

wherein said grip portions are positioned between said longitudinal ends and behind said rear wall of said longitudinal central portion in the mount direction;

said grip portions being provided at with a plurality of ribs extending in a direction transverse to the mount direction, and wherein a partition member is provided within the cavity between said upper and lower surfaces, said partition member being disposed at the longitudinal central portion of said electrophotographic photosensitive drum to divide said cavity extending in said longitudinal direction; and (d) said developing frame and said toner frame are integrally joined to each other to form a developing unit pivotally connected to said cleaning frame relative to each other, and the mount direction and a dismount direction of said process cartridge from the main body of said image forming apparatus are transverse to the longitudinal direction of said electrophotographic photosensitive drum; and (ii) convey means for conveying the recording medium.

* * * * *

UNITED STATES PATENT AND TRADEMARK OFFICE

CERTIFICATE OF CORRECTION

PATENT NO. : 5,802,433

DATED : September 1, 1998

INVENTOR(S) : MINORU SATO, ET AL.

It is certified that error appears in the above-identified patent and that said Letters Patent is hereby corrected as shown below:

COLUMN 1:

Line 11, "Ralated" should read --Related--;
Line 34, "deviative" should read --derivative--;
Line 64, "longitu-" should read --one longitudinal end--; and
Line 65, "dinal one end" should be deleted.

COLUMN 2:

Line 17, "longitudinal one end" should read --one longitudinal end--; and
Line 33, "longiduinal one end" should read --one longitudinal end--.

COLUMN 3:

Line 34, "to" should be deleted.

COLUMN 6:

Line 3, "the longitudinal both" should read --both longitudinal--;
Line 40, "toner," should read --toner difficult,--; and
Line 44, "does" should read --is--.

UNITED STATES PATENT AND TRADEMARK OFFICE

CERTIFICATE OF CORRECTION

PATENT NO. : 5,802,433

DATED : September 1, 1998

INVENTOR(S) : MINORU SATO, ET AL.

It is certified that error appears in the above-identified patent and that said Letters Patent is hereby corrected as shown below:

COLUMN 7:

Line 52, "jointed" should read --joined--.

COLUMN 8:

Line 15, "tangsten" should read --tungsten--; and
Line 18, "tangsten" should read --tungsten--.

COLUMN 9:

Line 6, "to" should be deleted.

COLUMN 13:

Line 26, "said" should read --the--.

Signed and Sealed this

Fourth Day of May, 1999

*Attest:*

*Attesting Officer*

Q. TODD DICKINSON

*Acting Commissioner of Patents and Trademarks*